US011329426B2

(12) United States Patent
Tanimura et al.

(10) Patent No.: US 11,329,426 B2
(45) Date of Patent: May 10, 2022

(54) CONNECTOR

(71) Applicant: Sumitomo Wiring Systems, Ltd., Yokkaichi (JP)

(72) Inventors: Shunsuke Tanimura, Yokkaichi (JP); Yuki Hirose, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 3 days.

(21) Appl. No.: 16/991,194

(22) Filed: Aug. 12, 2020

(65) Prior Publication Data

US 2021/0066850 A1 Mar. 4, 2021

(30) Foreign Application Priority Data

Aug. 26, 2019 (JP) ..... JP2019-153394

(51) Int. Cl.
*H01R 13/627* (2006.01)
*H01R 13/502* (2006.01)

(52) U.S. Cl.
CPC ..... *H01R 13/6273* (2013.01); *H01R 13/502* (2013.01)

(58) Field of Classification Search
CPC . H01R 13/631; H01R 13/6273; H01R 13/502
USPC ..... 439/381
See application file for complete search history.

(56) References Cited

U.S. PATENT DOCUMENTS

| | | | | |
|---|---|---|---|---|
| 4,992,054 | A * | 2/1991 | Cassan | H01R 13/56 439/150 |
| 5,533,909 | A * | 7/1996 | Endo | H01R 13/6215 439/140 |
| 5,599,200 | A * | 2/1997 | Yagi | H01R 13/6215 439/364 |
| 6,171,133 | B1 * | 1/2001 | Altuner | H05K 3/306 439/374 |
| 6,572,412 | B2 * | 6/2003 | Beuther | H05K 5/0069 439/381 |
| 6,939,163 | B2 * | 9/2005 | Fujita | H01R 13/4223 439/374 |
| 7,267,562 | B2 * | 9/2007 | Katsuma | H01R 13/516 439/140 |
| 2003/0119349 | A1 * | 6/2003 | Bakker | H01R 13/4538 439/140 |
| 2006/0205264 | A1 * | 9/2006 | Katsuma | H01R 13/4538 439/381 |

FOREIGN PATENT DOCUMENTS

JP 9-219235 8/1997

* cited by examiner

*Primary Examiner* — Gary F Paumen
(74) *Attorney, Agent, or Firm* — Gerald E. Hespos; Michael J. Porco; Matthew T. Hespos

(57) ABSTRACT

A moving plate moves from a protection position for protecting a tip part of a male tab to a connection position in a receptacle according to a connecting operation of a female housing. A male housing includes a male housing lock, and the female housing includes a female housing lock. The moving plate includes a plate male lock for locking the male housing lock at the protection position to restrict a movement to the connection position, and a plate female lock for locking the female housing-side locking portion to restrict separation of the female housing when locking of the male housing lock and the plate male lock is maintained.

9 Claims, 15 Drawing Sheets

CONNECTOR

BACKGROUND

Field of the Invention

This disclosure relates to a connector.

Related Art

Japanese Unexamined Patent Publication No. H09-219235 discloses a connector with a male connector including a receptacle, a moving plate to be movably assembled into the receptacle and a female connector to be fit into the receptacle. The moving plate includes guide holes into which male tabs of terminal fittings are insertable, and protects the male tabs of the terminal fittings while being arranged on an opening side of the receptacle.

The moving plate has a rib, and the female connector has an engaging arm. In the process of fitting the female connector into the receptacle, an engaging projection of the rib interferes with an engaging projection of the engaging arm to deflect and deform the engaging arm. After the female connector is fit, the engaging projection of the rib rides over the engaging projection of the engaging arm and the moving plate reaches a back side of the receptacle. In the process of separating the female connector, the engaging projection of the rib interferes with the engaging projection of the engaging arm from a side opposite to the one in the connecting process, and the engaging projections are locked to each other. In this way, the moving plate is moved toward the opening side of the receptacle together with the female connector.

In the case of Japanese Unexamined Patent Publication No. H09-219235, a spring deflection piece of the male connector locks a narrow part of a through window of the moving plate to restrict a drop of the moving plate to the back of the receptacle. At this time, the engaging projections of the rib and the engaging arm are not locked to each other yet. Thus, in starting an operation of connecting the female connector, it is not possible to restrict a movement of the female connector in a direction separating from the moving plate even if the drop of the moving plate is restricted. As a result, there is a possibility that the moving plate cannot smoothly move together with the female connector.

Accordingly, it is aimed to provide a connector in which a moving plate can smoothly move.

SUMMARY

This disclosure is directed to a connector with a male housing with a receptacle, a male tab projecting into the receptacle, a female housing to be fit into the receptacle, and a moving plate to be arranged in the receptacle. The moving plate moves from a protection position for protecting a tip part of the male tab to a connection position according to a connecting operation of the female housing. The male housing includes a male housing lock, the female housing includes a female housing lock, the moving plate includes a plate male lock for locking the male housing lock at the protection position to restrict a movement to the connection position, and a plate female lock for locking the female housing lock to restrict separation of the female housing when locking the male housing lock and the plate male lock is maintained.

According to this configuration, in a connection starting stage of the housings, a state where the male housing lock is locked to the plate male lock and a state where the female housing lock is locked to the plate female lock are realized simultaneously. Thus, in the connection starting stage of the housings, a mutual positional relationship of the moving plate, the female housing and the male housing is determined and a mutual interlocking relationship can be built. As a result, the moving plate can move smoothly from the protection position to the connection position according to the connecting operation of the female housing.

Note that "when the locking of the male housing lock and the plate male lock is maintained" means a state where the male housing lock and the plate male lock are locked with a predetermined locking margin.

A clearance for allowing the female housing to move toward the moving plate is set until the locking of the male housing lock and the plate male lock is released and the moving plate starts to move to the connection position. According to this configuration, the tip of the male tab is protected by the moving plate while the locking of the male housing lock and the plate male lock is released. Thus, reliability in protecting the male tab can be improved.

The female housing may include a female housing lock, and the moving plate may include a plate female lock for locking the female housing lock to enable a movement to the protection position when the locking of the male housing lock and the plate male lock is released at the time of separating the housings. According to this configuration, the moving plate can return toward the protection position according to a separating operation of the female housing.

DETAILED DESCRIPTION

A specific example of the connector of this disclosure is described below with reference to the drawings. Note that the invention is not limited to these illustrations and is defined by the claims including all changes in the meaning and scope of equivalents.

Figure 1:
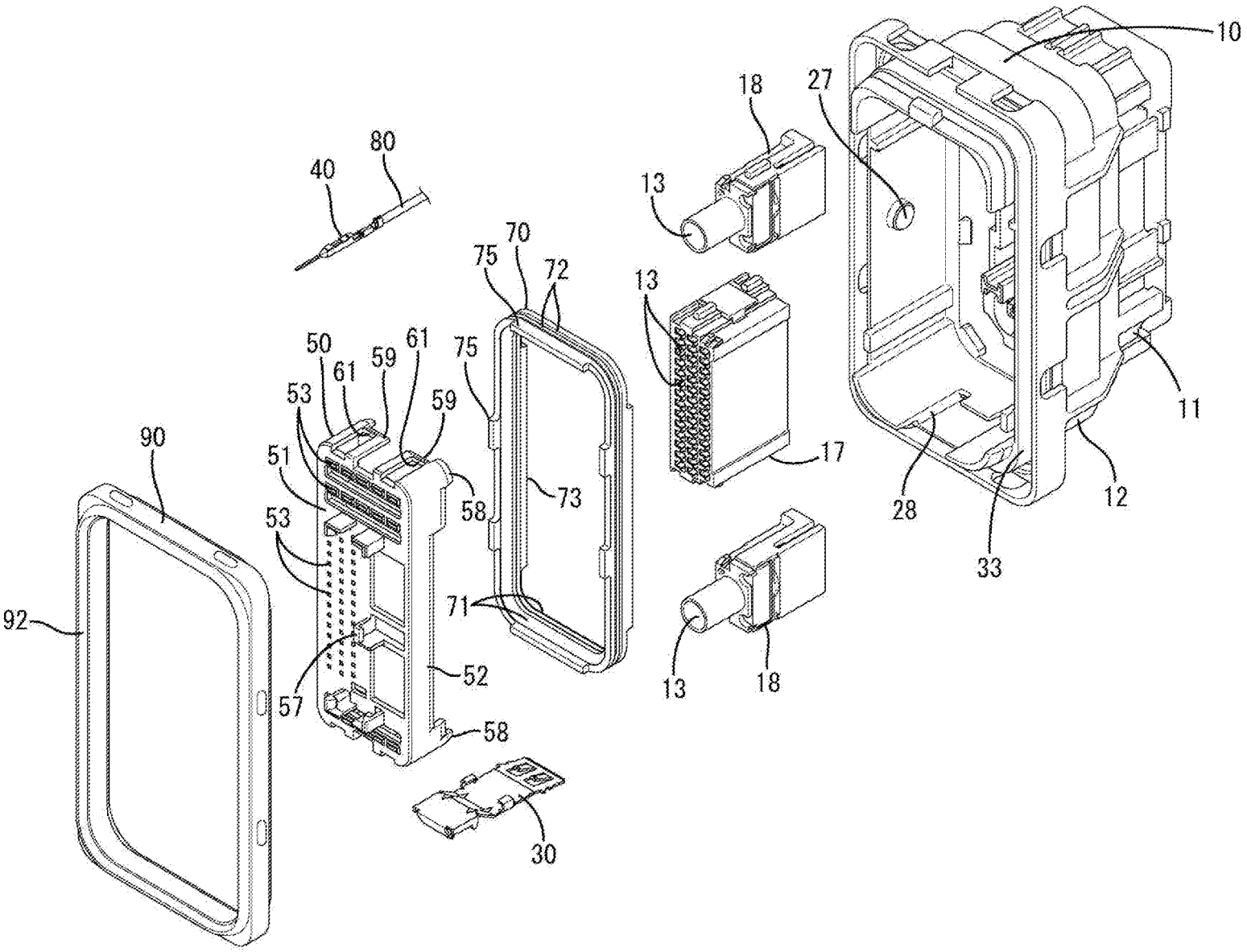
FIG. 1 is an exploded perspective view of a male connector.
Figure 2:
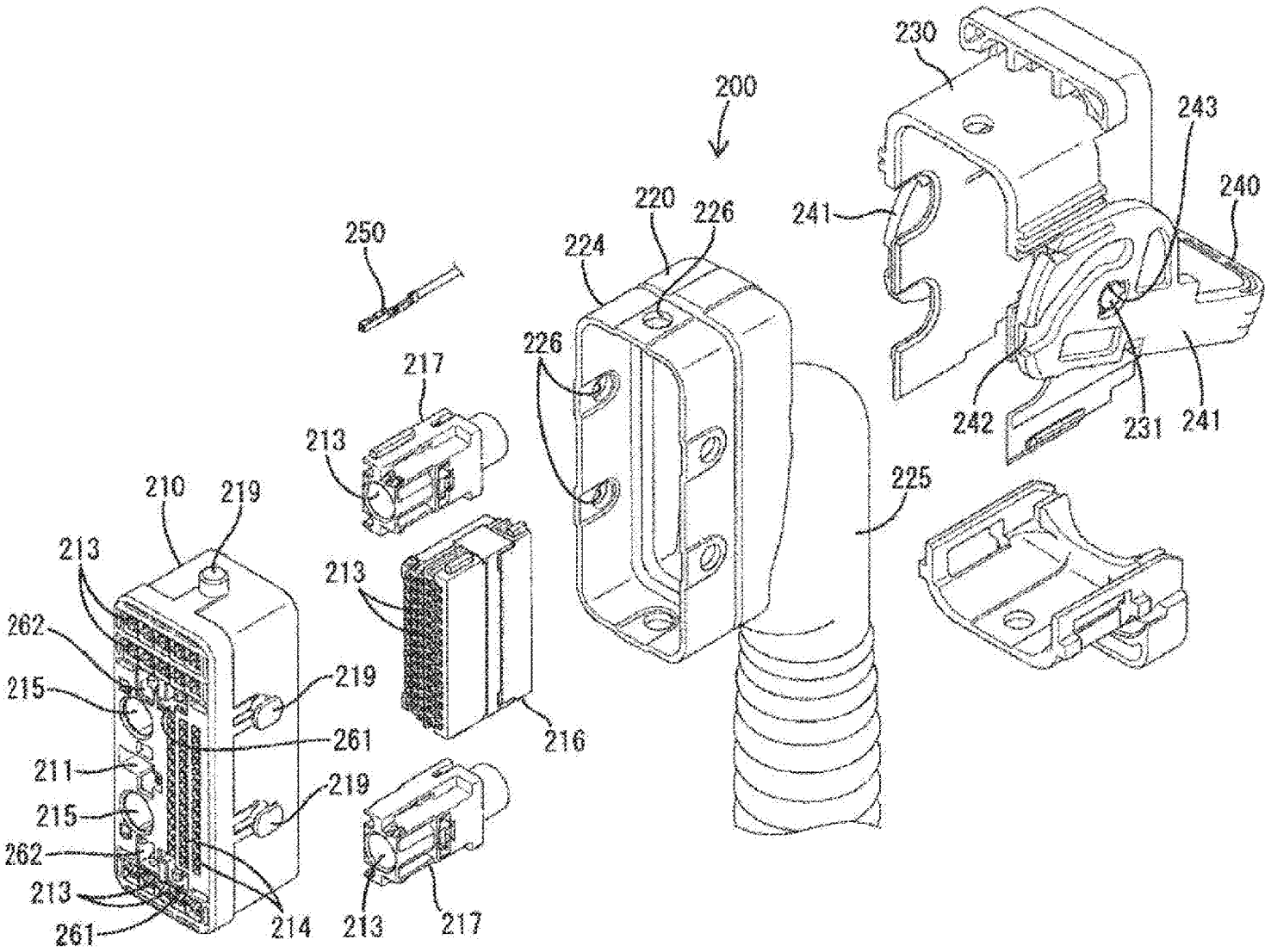
FIG. 2 is an exploded perspective view of a female connector.
Figure 10:
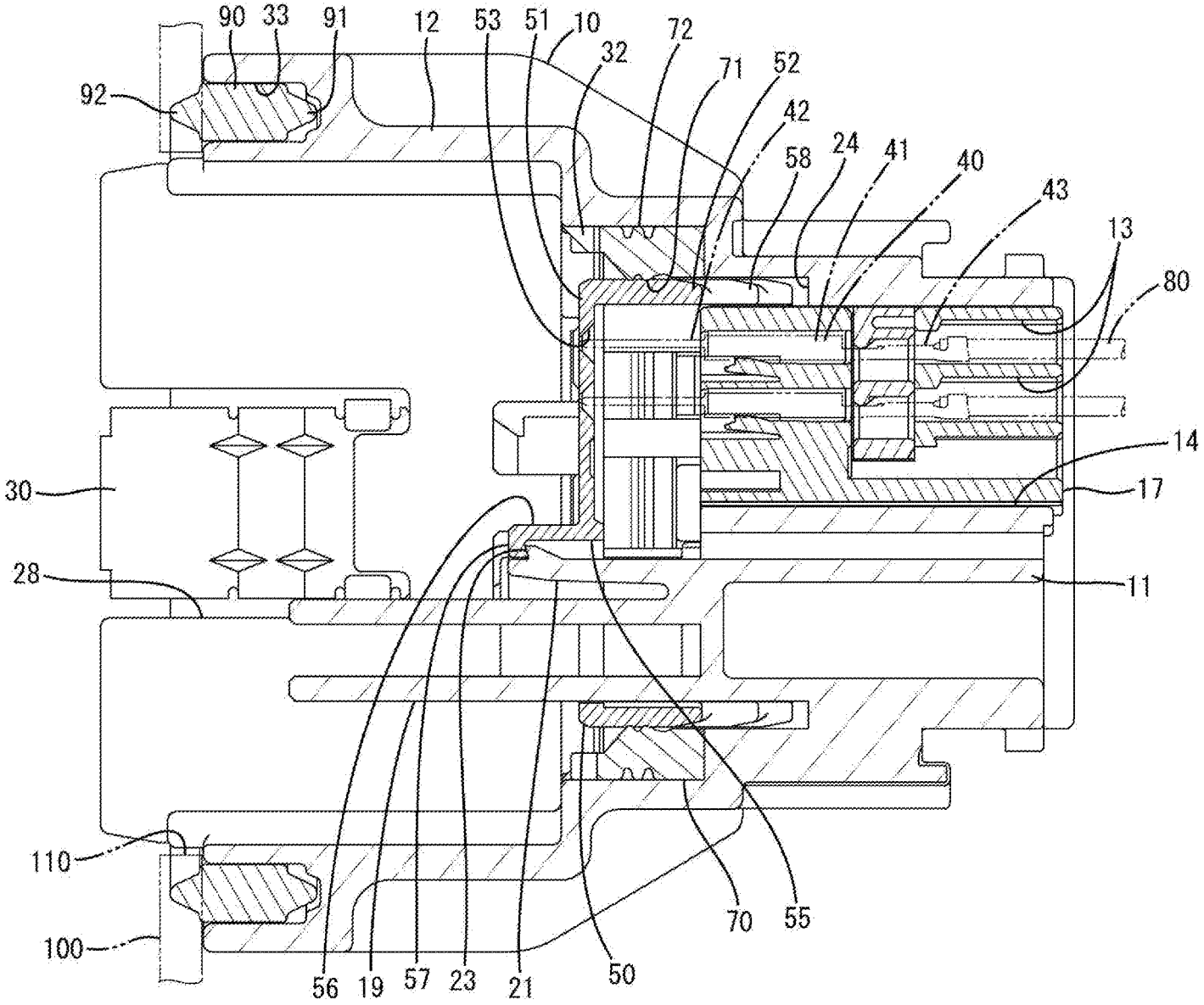
FIG. 10 is a section showing a state where the moving plate is arranged at a protection position with respect to a male housing.

A connector according to an embodiment includes a male housing 10 and a female housing 210 connectable to each other. The male housing 10 is configured as a part of a male connector. As shown in FIG. 1, the male connector includes male terminal fittings 40 to be accommodated into the male housing 10, a moving plate 50, a seal 70 and a panel seal 90. The female housing 210 is configured as a part of a female connector. As shown in FIG. 2, the female connector includes female terminal fittings 250, a grommet 220, a grommet cover 230 and a lever 240. As shown in FIG. 10, the male housing 10 is mounted on a panel 100, such as a door panel of an automotive vehicle and, in that state, connected to the female housing 210. A connecting operation of the housings 10, 210 proceeds by the rotation of the lever 240. Note that, in the following description, surfaces facing each other at the start of connection of both housings 10, 210 are referred to as front ends concerning a front-rear direction.

<Male Housing 10>

The male housing 10 is made of synthetic resin and includes, as shown in FIG. 1, a housing body 11 and a receptacle 12 projecting forward from the outer periphery of the front end of the housing body 11.

Figure 3:
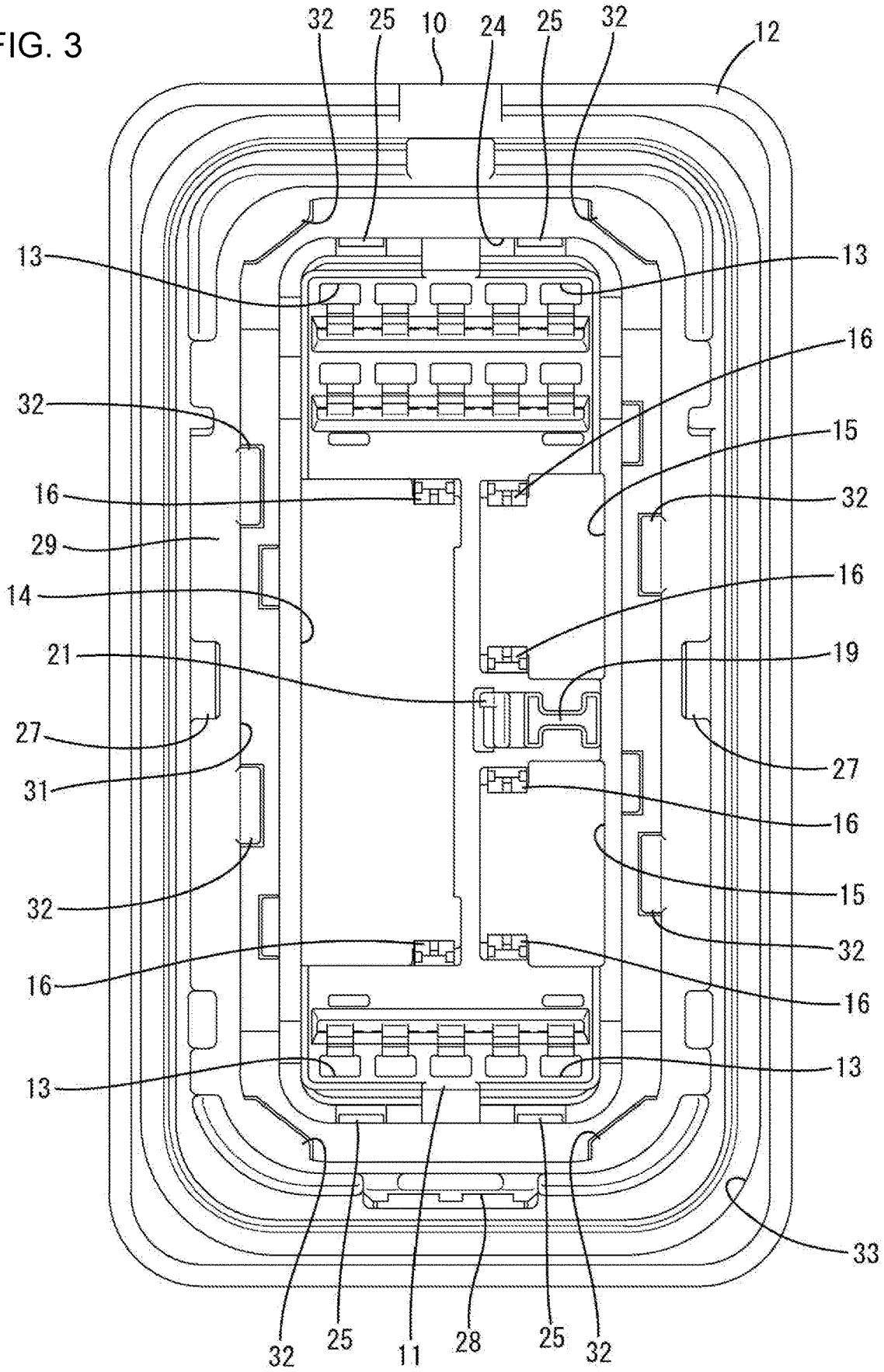
FIG. 3 is a front view of a housing body.

As shown in FIG. 3, the housing body 11 is vertically long and includes male cavities 13 in upper and lower end parts. First and second sub-housing accommodating portions 14, 15 penetrate a vertically intermediate part of the housing body 11 in the front-rear direction. The first sub-housing accommodating portion 14 is a vertically long rectangular opening arranged on one side (left side of FIG. 3) in a width direction of the housing body 11. Upper and lower second sub-housing accommodating portions 15 are rectangular openings arranged on the other side (right side of FIG. 3) adjacent to the first sub-housing accommodating portion 14 in the width direction. Each of the first and second sub-housing accommodating portions 14, 15 includes housing locks 16 at positions near a widthwise center of the housing body 11 on upper and lower surfaces.

Figure 7:
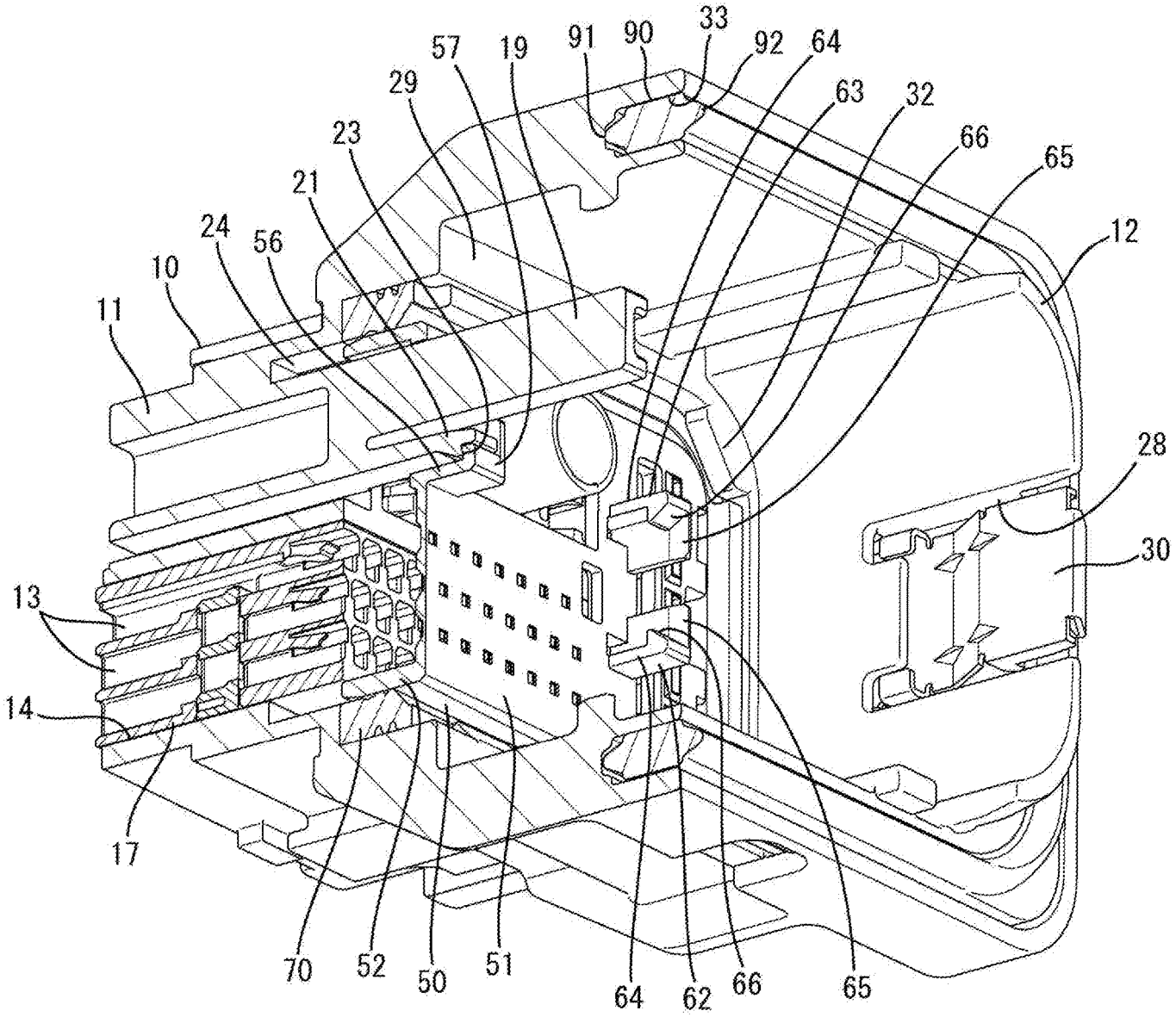
FIG. 7 is a perspective view in lateral section of a lower half of the male connector.

As shown in FIGS. 7 and 10, a first male sub-housing 17 is accommodated into the first sub-housing accommodating portion 14. The first male sub-housing 17 includes male cavities 13. A second male sub-housing 18 is accommodated into the second sub-housing accommodating portion 15. The second male sub-housing 18 includes one male cavity 13. The first and second male sub-housings 17, 18 are locked by the corresponding housing locks 16 to restrict escape from the first and second sub-housing accommodating portions 14, 15.

The male terminal fitting 40 is inserted into each of the male cavities 13 in the housing body 11 and the first male sub-housing 17, as shown in FIG. 10. An unillustrated coaxial terminal for coaxial cable is inserted and accommodated into the male cavity 13 of the second male sub-housing 18.

As shown in FIG. 3, the housing body 11 includes a projection 19 projecting into the receptacle 12 between the first and second sub-housing accommodating portions 14, 15 on the front surface. The projection 19 is inserted into a receiving portion 211 of the female housing 210 when the housings 10, 210 are connected in proper postures. On the other hand, the projection 19 is not inserted into the receiving portion 211 and interferes with the outer surface of the female housing 210 if an attempt is made to connect the housings 10, 210 in improper postures, thereby preventing erroneous connection of the housings 10, 210.

Figure 8:
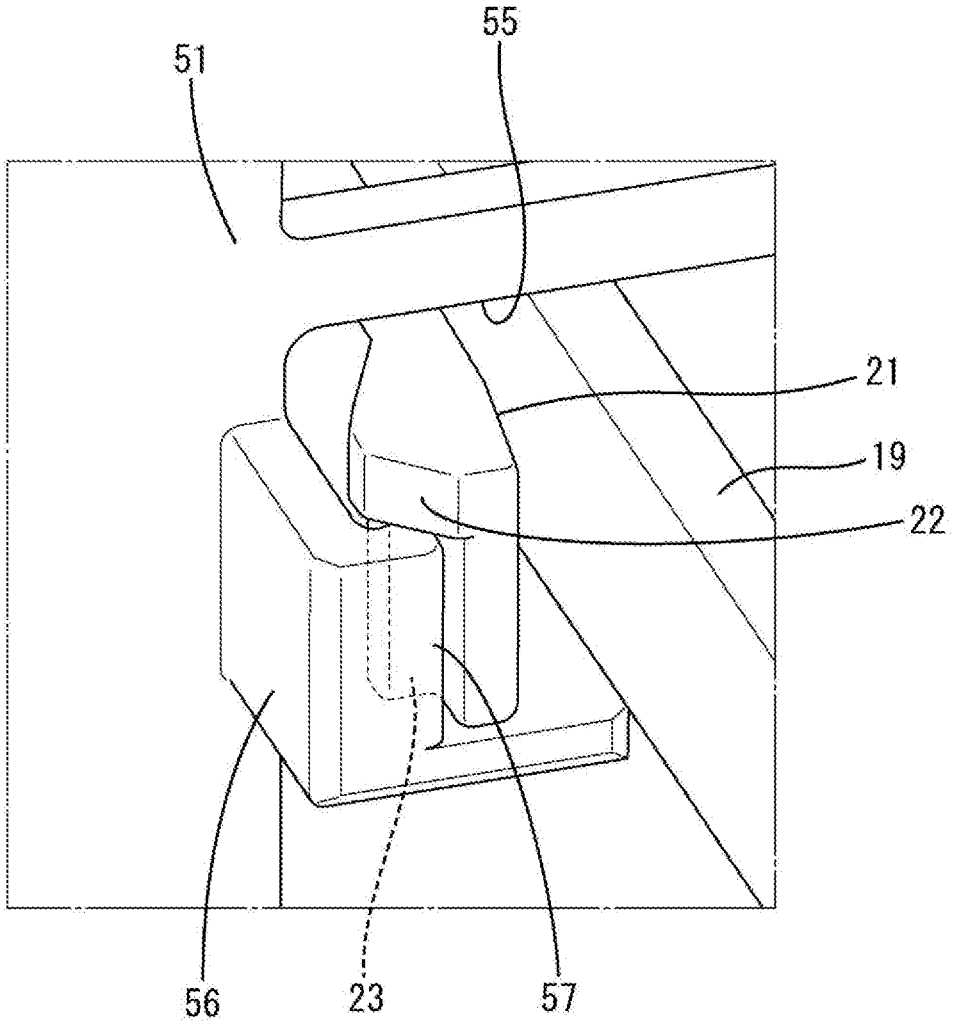
FIG. 8 is an enlarged perspective view showing a state where a rearward movement of the moving plate is restricted by the contact of a male engaging projection of a plate male locking portion with a locking surface of a male housing-side locking portion.

As shown in FIG. 3, the housing body 11 includes a male housing lock 21 at a position adjacent to the projection 19 on the front surface. As shown in FIGS. 7 and 10, a forward projecting dimension of the male housing lock 21 is smaller than that of the projection 19. The male housing lock 21 is deflectable and deformable with a side near the front surface of the housing body 11 as a fulcrum in the receptacle 12. As shown in FIG. 8, the male housing lock 21 has a release guiding surface 22 and a locking surface 23 vertically arranged on a part projecting toward one widthwise side (side opposite to the projection 19) on a tip part. The release guiding surface 22 has a smaller vertical dimension than the locking surface 23 on a side above the locking surface 23. The release guiding surface 22 is sloped to incline rearwardly on the front surface of the tip of the male housing lock 21. As shown in FIGS. 10 and 13, the locking surface 23 is formed into an overhanging shape inclined rearwardly on the front surface of the tip of the male housing lock 21.

Figure 9:
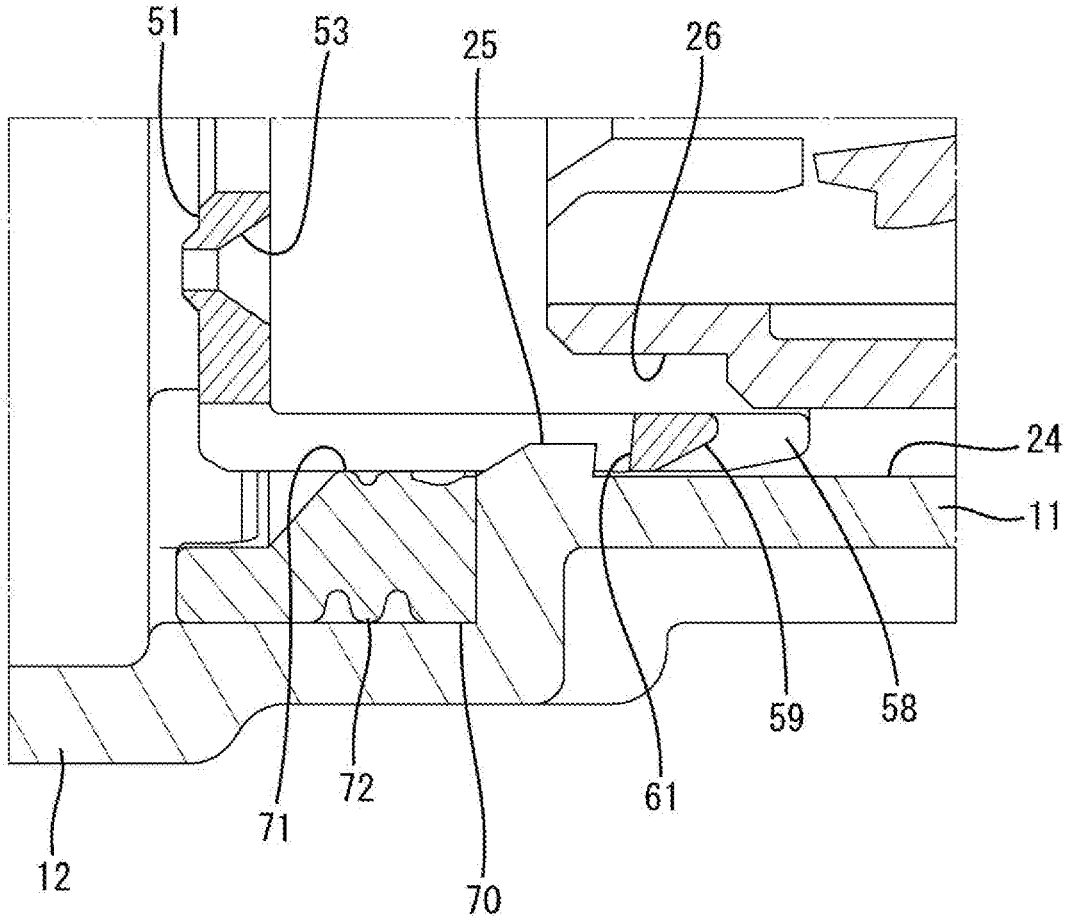
FIG. 9 is an enlarged section showing a state where a stopper enters a stopper receiving portion to restrict a forward movement of the moving plate.

As shown in FIG. 3, the housing body 11 includes an insertion recess 24 formed to collectively surround the upper and lower end parts including the male cavities 13 and the first and second sub-housing accommodating portions 14, 15 in an outer peripheral side of the front surface. The insertion recess 24 is a rectangular annular groove with four arcuately curved corners in a front view. The housing body 11 includes stoppers 25 paired in the width direction and projecting on upper and lower outer side surfaces of the insertion recess 24. As shown in FIG. 9, the front surface of the stopper 25 is sloped to incline rearward. The rear surface of the stopper 25 is perpendicular to the front-rear direction or formed into an overhanging shape inclined rearwardly.

The receptacle 12 includes side walls facing each other in the width direction and extending along the vertical direction and upper and lower walls facing each other in the vertical direction and extending along the width direction. As shown in FIG. 3, the receptacle 12 includes cylindrical cam followers 27 in vertically intermediate parts of the inner surfaces of the respective side walls. The cam followers 27 enter later-described cam grooves 242 of the lever 240 and slide in contact with surfaces of the respective cam grooves 242 as the lever 240 is rotated. In this way, the housings 10, 210 are connected and separated with a small connection/separation force.

As shown in FIGS. 7 and 10, the receptacle 12 includes a lock mounting portion 28 formed by cutting an inner surface side of a front part of the lower wall part. A lock 30 made of metal is mounted into the lock mounting portion 28. The male housing 10 is inserted into a mounting hole 110 in the panel 100, and retained and mounted on the panel 100 with the lock 30 locked to an opening edge of the mounting hole 110.

As shown in FIG. 7, the receptacle 12 includes a step 29 extending along a radial direction on a back part near the housing body 11. A region of the receptacle 12 located on a back side across the step 29 is reduced more in diameter than a region located on an opening side (front side), and the seal 70 is inserted and accommodated between the insertion recess 24 of the housing body 11 and the receptacle 12. The seal 70 is held in close contact with an outer peripheral region of the insertion recess 24 in the front surface of the housing body 11.

As shown in FIG. 3, the receptacle 12 includes hooks 32 projecting inward from the step 29. Each hook 32 is a projecting piece and, as shown in FIGS. 7 and 10, restricts a movement of the seal 70 in a direction to escape from the receptacle 12. In this embodiment, the respective hooks 32 are provided on four corners of the step 29 and on upper and lower parts on both widthwise sides of the step 29. Further, the receptacle 12 includes a part expanded in diameter toward a radially outer side on a front-end outer peripheral part and a mounting groove 33 is open in the front surface of that enlarged-diameter part. The panel seal 90 is inserted into the mounting groove 33 of the receptacle 12.

<Male Terminal Fittings 40>

The male terminal fitting 40 is formed, such as by bending a conductive metal plate and is elongated in the front-rear direction. As shown in FIG. 10, the male terminal fitting 40 includes a body 41, a male tab 42 projecting forward from the body 41 and a barrel 43 connected behind the body 41. The barrel 43 is connected electrically and mechanically to an end part of a wire 80. The body 41 is inserted into the male cavity 13 and retained. The male tab 42 project into the receptacle 12. As shown in FIG. 10, tips of the male tabs 42 are protected by the moving plate 50 before the connection of the housings 10, 210.

<Moving Plate 50>

The moving plate 50 is made of synthetic resin, inserted into the receptacle 12 and movable to a protection position and a connection position with respect to the male housing 10. As shown in FIG. 1, the moving plate 50 includes a protection wall 51 arranged along the vertical direction and the width direction and a peripheral wall 52 projecting rearward from an outer peripheral part of the protection wall 51.

Figure 4:
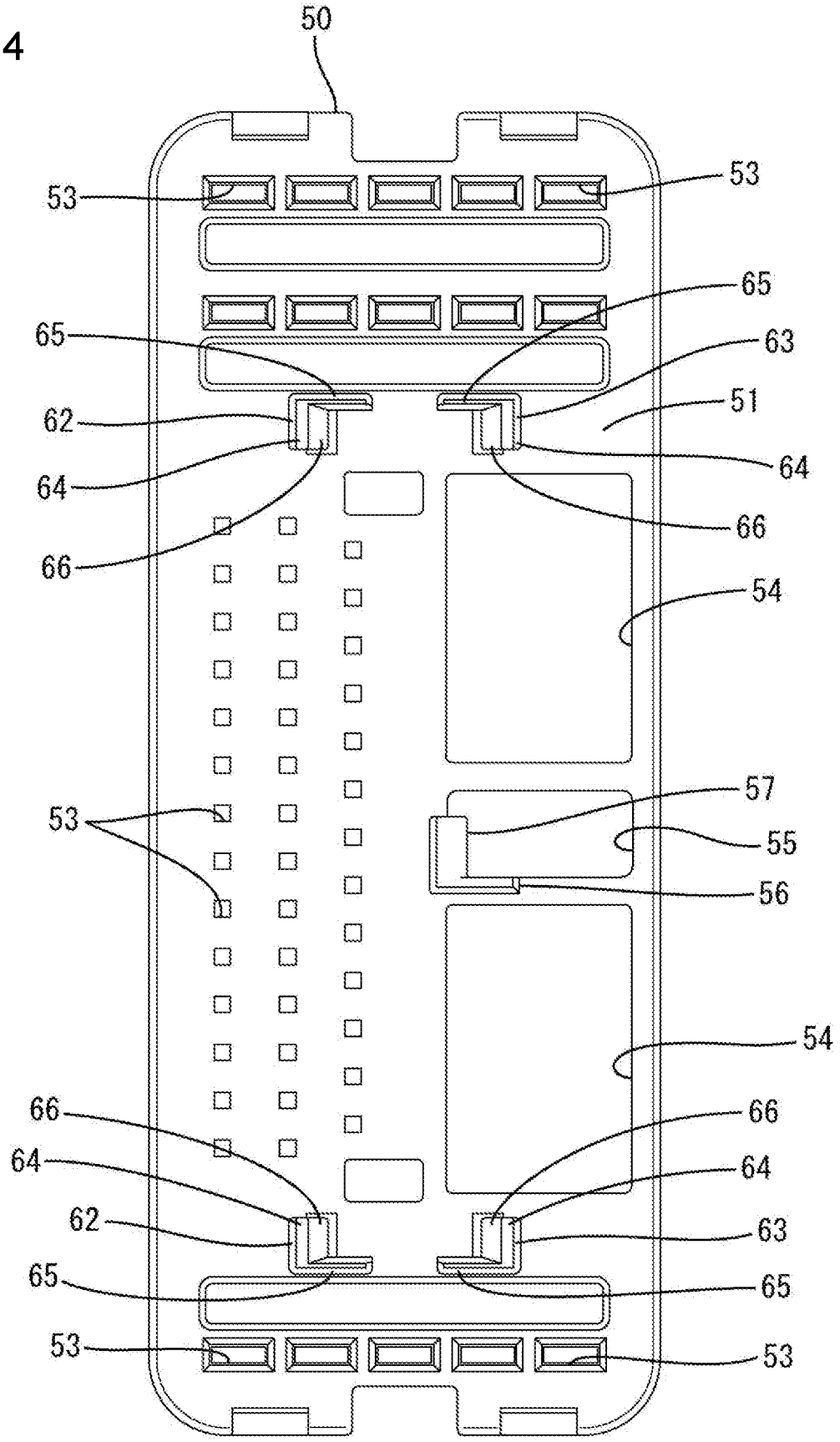
FIG. 4 is a front view of a moving plate.

As shown in FIG. 4, the protection wall 51 is a rectangular plate long in the vertical direction and has four curved corners in a front view. The protection wall 31 covers the front surface of the housing body 11 in the receptacle 12. The protection wall 51 includes positioning holes 53 at positions corresponding to the male cavities 13 in the upper and lower end parts of the housing body 11 and the respective male cavities 13 of the first male sub-housing 17. Each positioning hole 53 has a size and a shape so that the male tab 42 of the male terminal fitting 40 is insertable therein. The protection wall 51 includes housing insertion holes 54 at positions corresponding to the second sub-housing accommodating portions 15. Each housing insertion hole 54 has a rectangular opening long in the vertical direction, and a tubular part of the second male sub-housing 18 is inserted inside.

The protection wall 51 includes a through hole 55 between the housing insertion holes 54. The through hole 55 is a rectangular opening, and the projection 19 and the male housing-side locking portion 21 are inserted collectively inside, as shown in FIGS. 8 and 10.

Figure 13B:
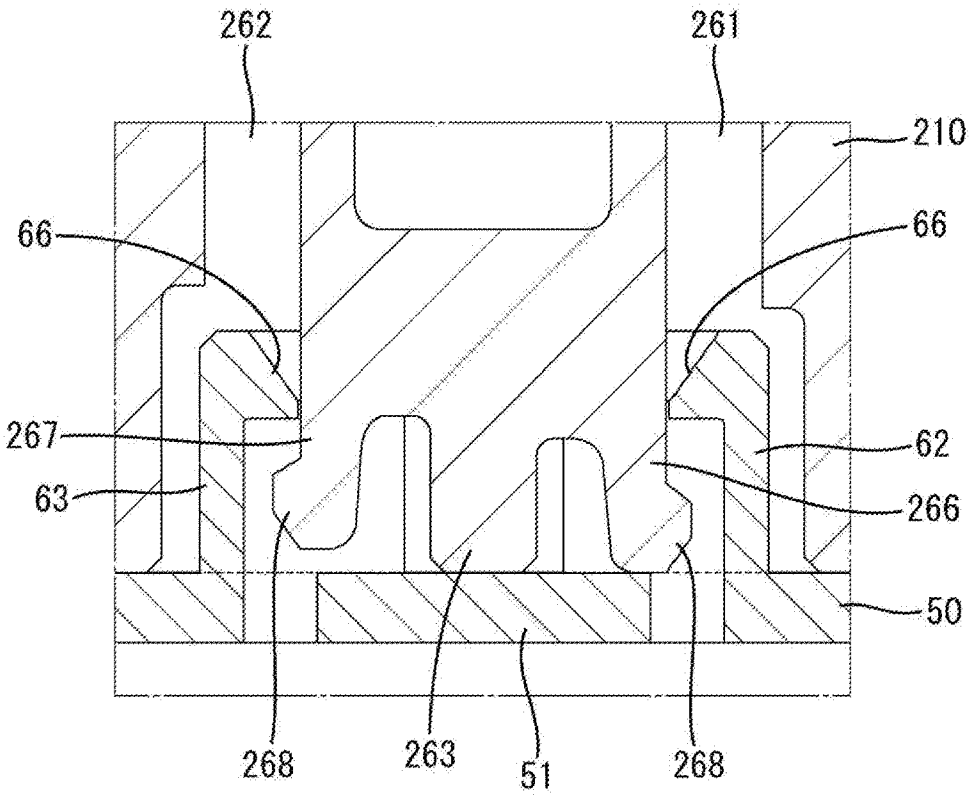
FIG. 13B is an enlarged section showing a state where the front surface of the female housing contacts the protection wall of the moving plate when the housings are connected properly.
Figure 13A:
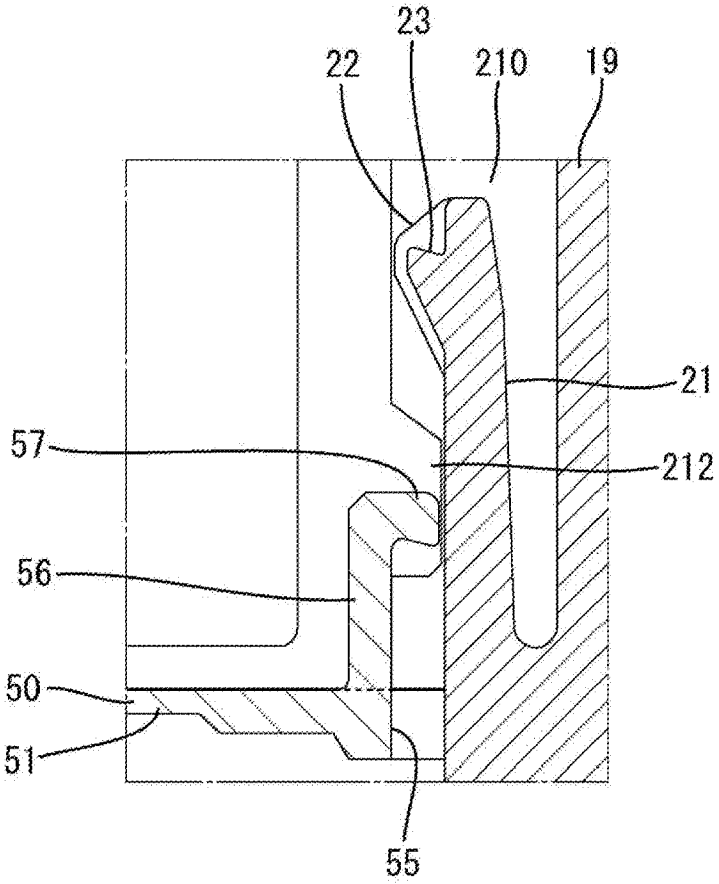
FIG. 13A is an enlarged section showing a state where the plate male locking portion is released from pressing by the releasing portion when the housings are connected properly.

As shown in FIGS. 4 and 8, the protection wall 51 includes a plate male lock 56 projecting forward from two side edges extending across a corner on a center lower side of the through hole 55 in the front surface. The plate male lock 56 is L-shaped in a front view and includes a rib-like male engaging projection 57 extending in the vertical direction on a tip on the side of the through hole 55. As shown in FIG. 13A, the rear surface of the male engaging projection 57 has an overhanging shape inclined rearward. As shown in FIGS. 7 and 10, a movement of the moving plate 50 from the protection position to the connection position is restricted by the contact of the rear surface of the male engaging projection 57 with the locking surface 23 of the male housing lock 21. The front surface of the male engaging projection 57 extends along the width direction.

As shown in FIG. 4, the protection wall 51 includes plate female locks 62 and 63 paired in the width direction at positions above and below the respective housing insertion holes 54 and closer to a vertical center than the respective positioning holes 53 in the upper and lower end parts. The plate female locks 62 and 63 are symmetrical in the width direction with respect to a widthwise center of the protection wall 51.

Figure 15B:
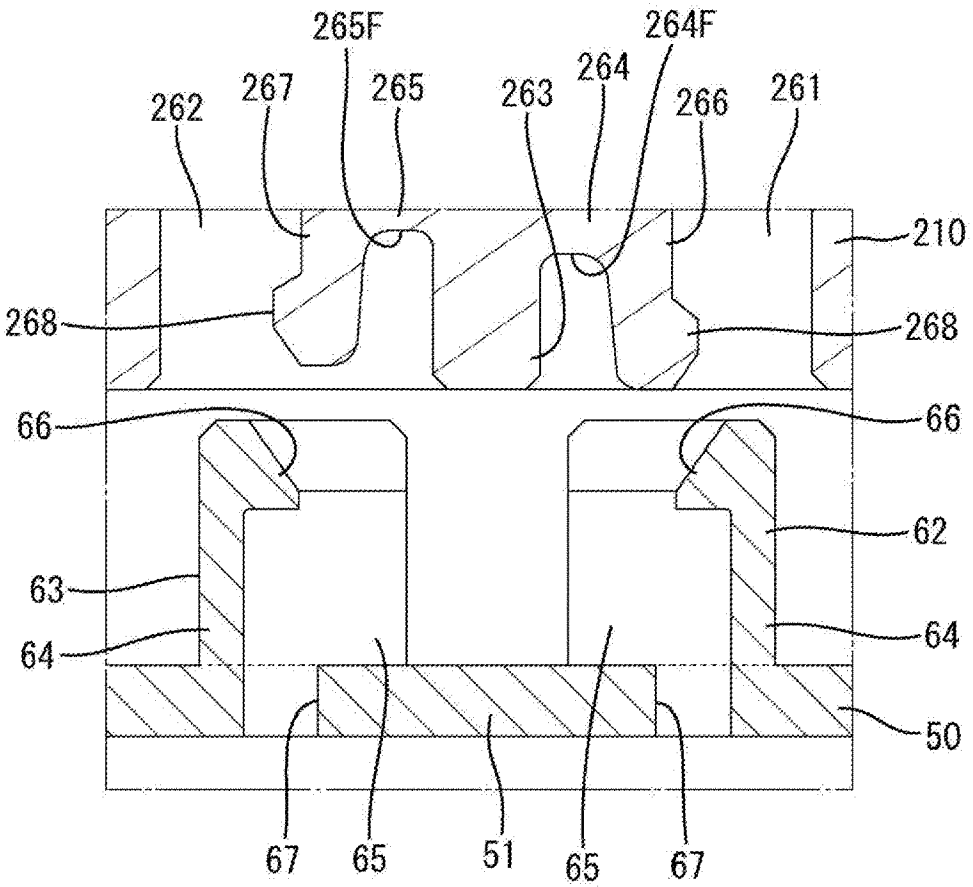
FIG. 15B is an enlarged section showing a state where the plate female locking portion and the plate female lock portion come out from the locking hole and the lock hole of the female housing when the separation of the housings is completed.

The plate female locks 62 and 63 have the same shape and are configured as projecting pieces projecting forward from the front surface of the protection wall 51, as shown in FIGS. 7 and 15B. Each of the plate female locks 62 and 63 includes a first piece 64 arranged along the vertical direction and a second piece 65 arranged along the width direction, as shown in FIGS. 4 and 7. The first and second pieces 64, 65 are connected to each other via an outer (upper or lower) corner part and are L-shaped in a front view.

Figure 11B:
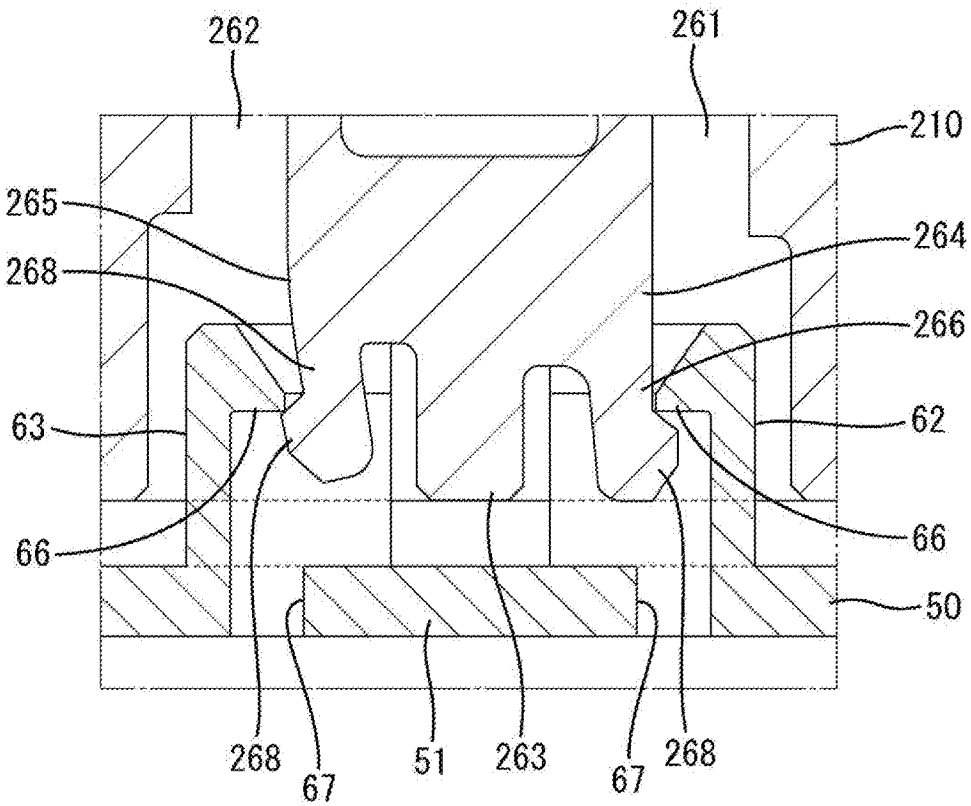
FIG. 11B is an enlarged section showing a state before a female housing lock portion is locked to a plate female lock portion while a female housing locking portion is locked to a plate female locking portion in the connection starting stage of the housings.

The plate-side female locks 62 and 63 include rib-like plate engaging projections 66 extending along the vertical direction on widthwise inner sides (sides facing each other) on tips of the first pieces 64. The plate engaging projection 66 is formed over the entire height of the first piece 64 and an outer end (upper or lower end) thereof is connected to the second piece 65. As shown in FIG. 11B, the rear surface of the plate engaging projection 66 extends along the width direction. The front surface of the plate engaging projection 66 is sloped to incline rearward.

As shown in FIG. 11B, the protection wall 51 includes through holes 67 at positions facing the rear surfaces of the respective plate engaging projections 66. The through holes 67 are formed by the passage of an unillustrated mold for forming the rear surfaces of the respective plate engaging projections 66.

Figure 5:
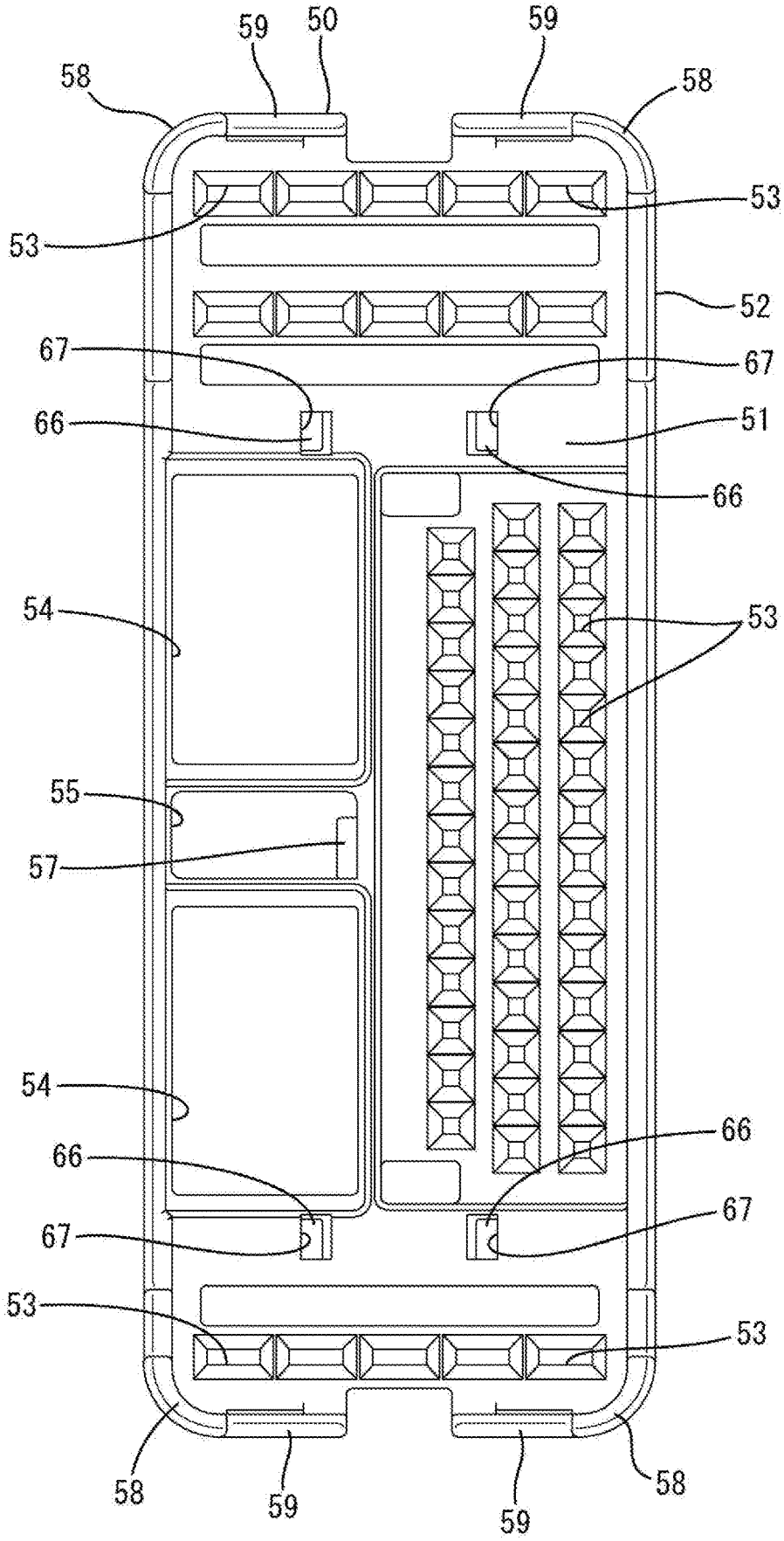
FIG. 5 is a back view of the moving plate.

As shown in FIG. 5, the peripheral wall 52 is connected to the outer peripheral part of the protection wall 51 except widthwise middle parts of upper and lower ends. The outer peripheral surface of the peripheral wall 52 is arranged along the front-rear direction to face the inner peripheral surface of the seal 70. The peripheral wall 52 includes projecting pieces 58 projecting rearward on four corner parts. The projecting pieces 58 are arcuate in a back view to correspond to the curved shape of the four corners. The projecting pieces 58 are inserted deep into the four corners of the insertion recess 24 of the housing body 11 (see FIG. 9) to restrict inclination of the moving plate 50 about an axis in the receptacle 12.

As shown in FIG. 5, the peripheral wall 52 includes retaining portions 59 connected to the projecting pieces 58 and extending along the width direction on both widthwise end parts of the upper and lower ends. As shown in FIG. 1, the retaining portion 59 includes a stopper receiving portion 61 in the form of a long hole extending in the front-rear direction in a central part and having a front end open in the front surface of the protection wall 51 and a closed rear end. As shown in FIG. 9, a closing surface of the stopper receiving portion 61 is inclined rearwardly toward an outer side. The stoppers 25 are inserted into the stopper receiving portions 61 of the peripheral wall 52. A movement of the moving plate 50 in the direction to escape from the receptacle 12 is restricted by the contact of the closing surfaces on the rear ends of the stopper receiving portions 61 with the stoppers 25.

<Seal 70>

The seal member 70 is made of rubber, such as silicon rubber, and is arranged along the inner periphery of the back side of the receptacle 12. As shown in FIG. 1, the seal 70 has a vertically long rectangular shape with four arcuately curved corners in a front view. The seal 70 has a predetermined thickness in the front-rear direction and includes front and rear inner peripheral lips 71 on an inner peripheral surface and front and rear outer peripheral lips 72 on an outer peripheral surface.

<Panel Seal 90>

The panel seal 90 is made of rubber such as silicon rubber and accommodated into the mounting groove 33 of the receptacle 12. As shown in FIG. 1, the panel seal member 90 has a rectangular annular shape one size larger than the seal member 70 in a front view. As shown in FIG. 10, the panel seal 90 includes a rear lip 91 projecting rearward and to be held in close contact with the back surface of the mounting groove 33 and a front lip 92 projecting forward and to be held in close contact with an opening edge of the mounting hole 110 in the plate surface of the panel 100. The panel seal 90 is sandwiched between the male housing 10 and the panel 100 via the front and rear lips 92, 91 to seal between the male housing 10 and the panel 100 in a liquid-tight manner.

<Female Housing 210>

The female housing 210 is made of synthetic resin and, as shown in FIG. 2, is in the form of a vertically long rectangular block. The female housing 210 includes female cavities 213 in upper and lower end parts. Further, the female housing 210 includes tab insertion holes 214 on one widthwise side (right side of FIG. 2) near a vertical center in a front part, and upper and lower circular through holes 215 on the other widthwise sides (left side of FIG. 2) near the vertical center in the front part. When the housings 10, 210 are connected, the male tabs 42 of the male terminal fittings 40 are inserted into the respective tab insertion holes 214 and the tubular parts of the second male sub-housings 18 are inserted into the respective through holes 215.

The female housing 210 includes unillustrated accommodation spaces behind the front part. A first female sub-housing 216 is accommodated into one accommodation space provided on the one widthwise side near the vertical center of the female housing 210. Second female sub-housings 217 are accommodated in upper and lower accommodation spaces provided on the other widthwise side near the vertical center of the female housing 210. The first female sub-housing 216 includes female cavities 213, while the second female sub-housing 217 includes one female cavity 213. When the first and second female sub-housings 216, 217 are accommodated in the corresponding accommodation spaces, the female cavities 213 of the first and second female sub-housings 216, 217 communicate with the respective tab insertion hole 214 and the through holes 215. The female terminal fitting 250 is inserted into and accommodated in each female cavity 213 from behind.

The female housing 210 includes the receiving portion 211 on the other widthwise side of a vertically central part and between the respective through holes 215. The receiving portion 211 is formed by recessing the front surface of the female housing 210. The receiving portion 211 includes a trapezoidal releasing portion 212 projecting on an inner surface on the side of the respective tab insertion holes 214 (see FIG. 11A). The front surface of the releasing portion 212 extends along the width direction. The rear surface of the releasing portion 212 is sloped to incline forward.

As shown in FIG. 2, the front part of the female housing 210 includes locking holes 261 and lock holes 262 at positions above and below the respective through holes 215 and the respective tab insertion holes 214 and closer to the vertical center than the female cavities 213 in the upper and lower parts. The locking holes 261 and the lock holes 262 are recessed side by side in the width direction in the front surface of the female housing 210. The locking hole 261 is open on one widthwise side in the front surface of the female housing 210, and the lock hole 262 is open on the other widthwise side in the front surface of the female housing 210.

Figure 6:
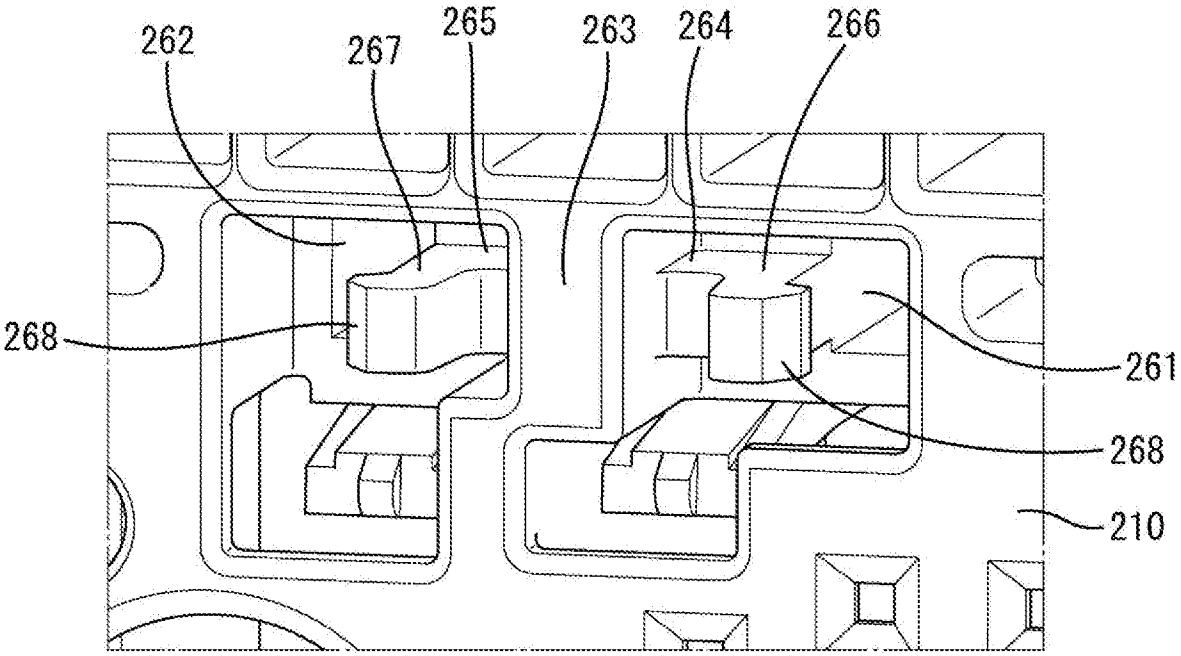
FIG. 6 is an enlarged perspective view of a part of a female housing corresponding to a locking hole and a lock hole.

As shown in FIGS. 6 and 15B, the front part of the female housing 210 includes separation walls 263 arranged between the locking holes 261 and the lock holes 262. The front part of the female housing 210 includes first back walls 264 integrally connected to the separation walls 263 in the locking holes 261 and second back walls 265 integrally connected to the separation walls 263 in the lock holes 262. As shown in FIG. 15B, front surfaces 264F, 265F of the first and second back walls 264, 265 cross the back ends of the respective side surfaces of the separation wall 263. The front surface 264F of the first back wall 264 is arranged in front of the front surface 265F of the second back wall 265.

The front part of the female housing 210 includes female housing locks 266 projecting forward from the front surfaces 264F of the first back walls 264 in the locking holes 261. Further, the front part of the female housing 210 includes female housing locks 267 projecting forward from the front surfaces 265F of the second back walls 265 in the lock holes 262. The female housing locks 266 and 267 are arranged side by side with the separation wall 263 with clearances defined between the separation wall 263 and the female housing locks 266 and 267. The female housing locks 266 and 267 are deflected and deformed in directions toward the separation wall 263 with parts of the first and second back walls 264, 265 on the sides of the front surfaces 264F, 265F as fulcrums.

As shown in FIG. 15B, the tip of the female housing lock 266 is arranged at the same position as the tip of the separation wall 263 (front end of the female housing 210) in the front-rear direction. The tip of the female housing lock 267 is arranged behind the tip surface of the separation wall 263. A projecting dimension of the female housing lock 266 from the front surface 264F of the first back wall 264 is equal to that of the female housing lock 267 from the front surface 265F of the second back wall 265. The female housing locks 266 and 267 have the same shape, but are bilaterally asymmetrical in the width direction since being shifted in the front-rear direction.

Figure 14B:
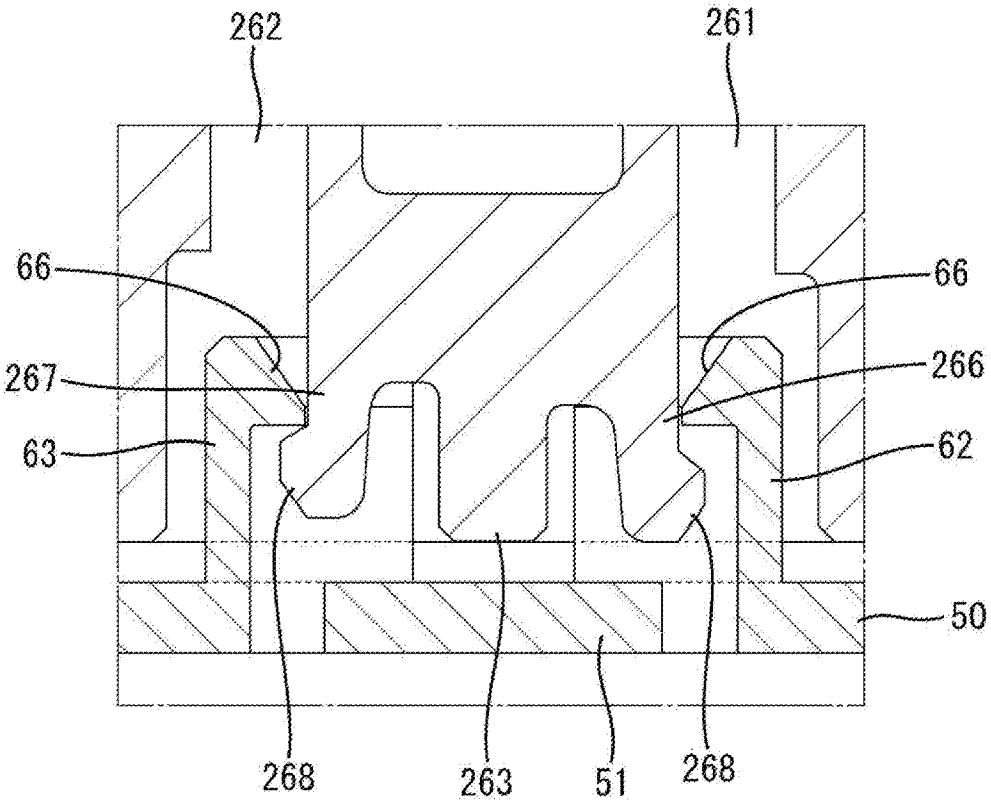
FIG. 14B is an enlarged section showing a state where the female housing-side lock is locked to the plate female lock portion in the process of separating the housings.

Each of the female housing locks 266 and 267 includes a claw-like female engaging projection 268 projecting outward (side opposite to the separation wall 263) in the width direction from the tip. The front surface of the female engaging projection 268 is sloped to incline rearward. The rear surface of the female engaging projection 268 is sloped to incline forward. As shown in FIG. 11B, the female engaging projection 268 of the female housing lock 266 contacts the plate engaging projection 66 of the plate female lock 62 to be locked when the connection of the housings 10, 210 is started. As shown in FIG. 14B, the female engaging projection 268 of the female housing lock 267 contacts the plate engaging projection 66 of the plate female lock 63 to be locked when separating the housings 10, 210. As also shown in FIG. 2, the female housing 210 includes projection-like stops 219 at plural positions spaced apart in a circumferential direction on the outer peripheral surface (upper and lower surfaces and left and right surfaces). The seal 70 is held in close contact with a front part of the outer peripheral surface of the female housing 210.

<Grommet 220>

The grommet 220 is made of rubber and mounted on the female housing 210 from behind. As shown in FIG. 2, the grommet 220 includes a tubular cover 224 for covering the female housing 210 and a pipe 225 for covering wires drawn out from the female housing 210. The cover 224 of the grommet 220 is held in close contact with a rear region of the outer peripheral surface of the female housing 210. The grommet 220 includes stopping holes 226 at positions spaced apart in the circumferential direction. The stops 219 of the female housing 210 are fit and fixed to the respective stopping holes 226 of the grommet 220 to mount the grommet 220 on the female housing 210.

<Grommet Cover 230>

The grommet cover 230 is made of synthetic resin and, as shown in FIG. 2, is cap-shaped and mounted on the female housing 210 from behind, following the grommet 220. The grommet cover 230 holds the grommet 220 by sandwiching the grommet 220 between the female housing 210 and the grommet cover 230. The grommet cover 230 includes side plate parts paired in the width direction and projection-like support shafts 231 on outer surfaces of both side plate parts.

<Lever 240>

The lever 240 is made of synthetic resin and, as shown in FIG. 2, has a U-shape. The lever 240 is mounted to straddle over the grommet cover 230 from behind. The lever 240 includes two cam plates 241 facing each other in a width direction. Each cam plate 241 includes the cam groove 242 in an outer surface. Each cam plate 241 includes a bearing hole 243 to be fit to the support shaft 231 of the grommet cover 230 and is rotated about the bearing hole 243.

<Connection/Separation Method of Both Housings 10, 210>

Prior to the connection of the housings 10, 210, the seal 70 is inserted into the receptacle 12. The rear end of the seal 70 contacts the outer peripheral region of the insertion recess 24 in the front surface of the housing body 11 and the front end thereof contacts the respective hooks 32. In this way, the seal 70 is held with movements in the front-rear direction with respect to the male housing 10 restricted.

Subsequently, the moving plate 50 is inserted into the receptacle 12. In the process of inserting the moving plate 50, the retaining portions 59 slide in contact with the front surfaces of the respective stoppers 25. If the respective retaining portions 59 ride over the respective stoppers 25 and resiliently return, the stoppers 25 are fit into the stopper receiving portions 61 of the respective retaining portions 59 (see FIG. 9). A forward movement (movement in the direction to escape from the receptacle 12) of the moving plate 50 is restricted by the contact of the closing surfaces of the stopper receiving portions 61 of the retaining portions 59 with the respective stoppers 25. Further, the male housing lock 21 is inserted into the through hole 55 of the protection wall 51 and the male engaging projection 57 of the plate male lock 56 contacts the locking surface 23 of the male housing lock 21 to restrict a rearward movement (movement toward the connection position) of the moving plate 50 (see FIGS. 8 and 10). In this way, the moving plate 50 is arranged at the protection position with movements in the front-rear direction restricted. At the protection position, the protection wall 51 is arranged away from the front surface of the housing body 11 in the receptacle 12.

In a state where the moving plate 50 is at the protection position and each male terminal fitting 40 is accommodated in each male cavity 13, the tip of the male tab 42 of each male terminal fitting 40 is positioned and inserted in each positioning hole 53 of the protection wall 51. In this way, the interference of external matter with the tips of the male tabs 42 is avoided and the deformation of the male tabs 42 is prevented. Further, at the protection position, the projection 19 passes through the through hole 55 of the protection wall 51 and projects into the receptacle 12. If an attempt is made to fit the female housing 210 in an improper posture inclined from a proper posture into the receptacle 12, the tip of the projection 19 butts against the front surface (front surface when viewed from the female housing 210) of the female housing 210 to avoid interference of the female housing 210 with the tips of the male tabs 42.

As shown in FIG. 10, when the moving plate 50 is at the protection position, the peripheral wall 52 faces the inner peripheral surface of the seal 70. The outer peripheral surface of the peripheral wall 52 is in contact with the tip of each inner peripheral lip 71 of the seal 70. In this way, the adhesion of foreign matter, such as dust and dirt, cannot adhere to the inner peripheral surface of the seal 70.

The male housing 10 is connected to the female housing 210 while being mounted on the panel 100. If the female housing 210 is inserted into the receptacle 12 when the connection of the housings 10, 210 is started, each cam follower 27 enters the entrance of each cam groove 242 of the lever 240.

Figure 11A:
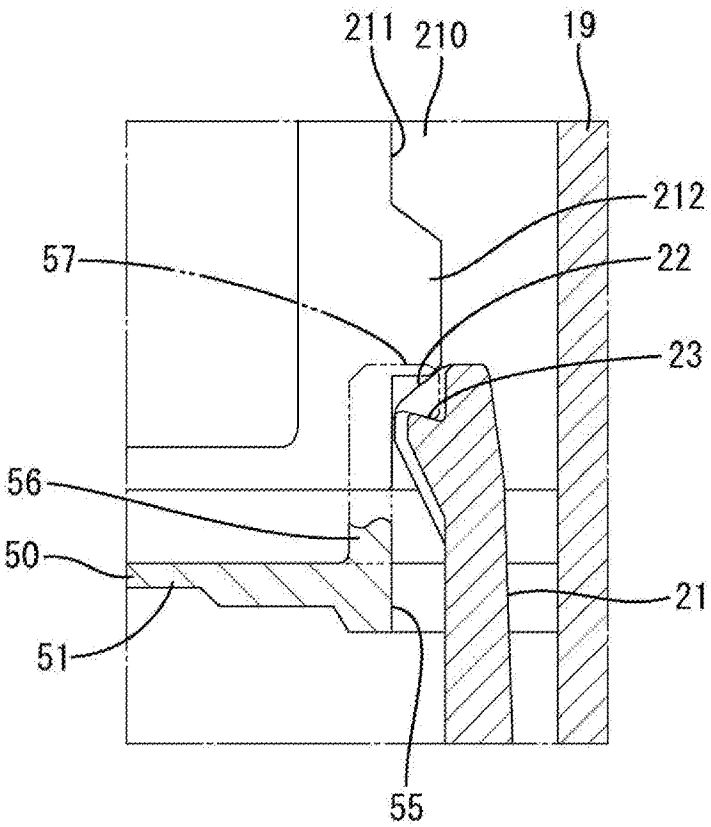
FIG. 11A is an enlarged section showing a state where the plate male locking portion starts to contact a releasing portion while being kept locked to the male housing locking portion in a connection starting stage of the housings.

In a stage where each cam follower 27 enters the entrance of each cam groove 242 of the lever 240 at the start of connection of the housings 10, 210 (hereinafter, referred to as a connection starting stage), the tip of the male housing lock 21 enters the receiving portion 211 and the release guiding surface 22 of the male housing lock 21 faces and contacts the releasing portion 212, as shown in FIG. 11A.

In the connection starting stage, a state where the male engaging projection 57 of the plate male lock 56 is locked to the locking surface 23 of the male housing lock 21 is maintained and a rearward movement (rearward movement when viewed from the side of the male housing 10, movement toward the connection position) of the moving plate 50 with respect to the male housing 10 is restricted.

Further, in the connection starting stage, as shown in FIG. 11B, the plate female locks 63 enter the lock holes 262, the female engaging projections 268 of the female housing locks 267 slide in contact with the plate engaging projections 66 of the plate female locks 63 and the female housing locks 267 are deflected toward the separation walls 263.

On the other hand, the plate female locks 62 enter the locking holes 261 and, before reaching the connection starting stage, the female engaging projections 268 of the female housing locks 266 slide in contact with the plate engaging projections 66 of the plate female locks 62 and the female housing locks 266 are deflected toward the separation walls 63.

In the connection starting stage, the female housing locks 266 resiliently return and the female engaging projections 268 of the female housing locks 266 are locked to the plate engaging projections 66 of the plate female locks 62, as shown in FIG. 11B to restrict a rearward movement of the moving plate 50 with respect to the female housing 210.

As described above, in the connection starting stage, the female housing locks 266 are locked to the plate female locks 62 at the same time as the male housing lock 21 is locked to the plate male lock 56 to restrict an inadvertent rearward movement of the moving plate 50 to the protection position with respect to the male housing 10. Further, in the connection starting stage, a movement of the female housing 210 in a direction away from the moving plate 50 (forward direction when viewed from the male housing 10) is restricted by the locking of the female housing locks 266 and the plate female locks 62. Thus, position deviations of the female housing 210, the male housing 10 and the moving plate 50 from each other are restricted in the connection starting stage.

The connection of the housings 10, 210 proceeds by rotating the lever 240 from the connection starting stage. As described above, the female housing-side locks 266 and the plate female locks 62 are locked in the connection starting stage. Thus, the female housing 210 and the moving plate 50 can move smoothly together.

Figure 12B:
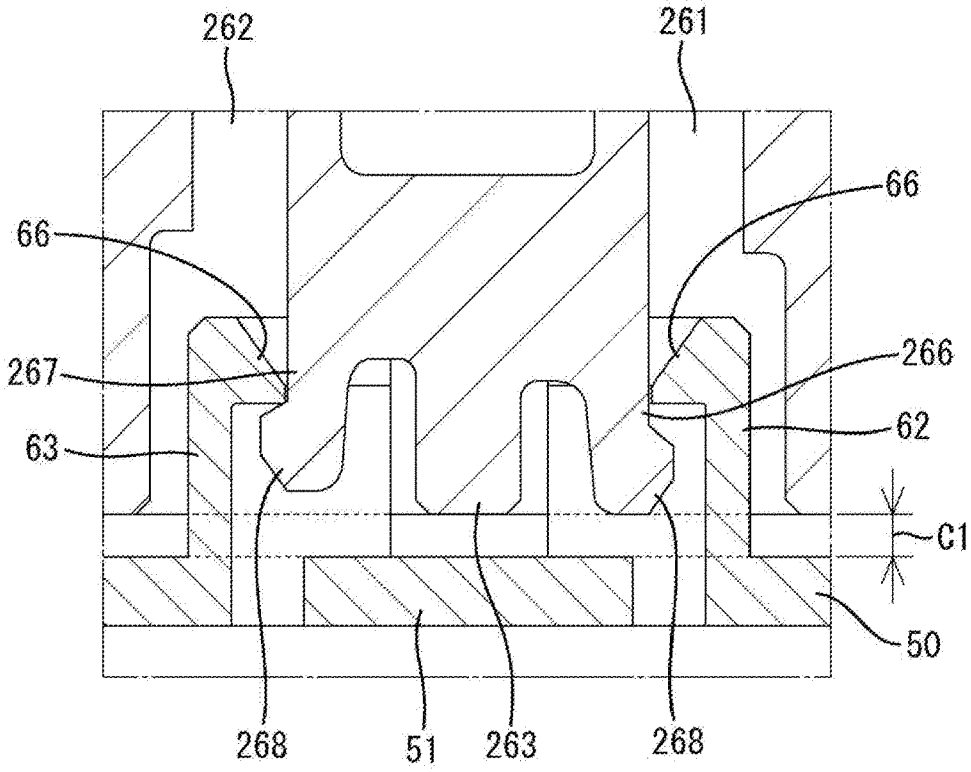
FIG. 12B is an enlarged section showing a state where the front surface of the female housing is facing a protection wall of the moving plate with a clearance defined between the protection wall and the front surface of the female housing in the process of connecting the housings.
Figure 12A:
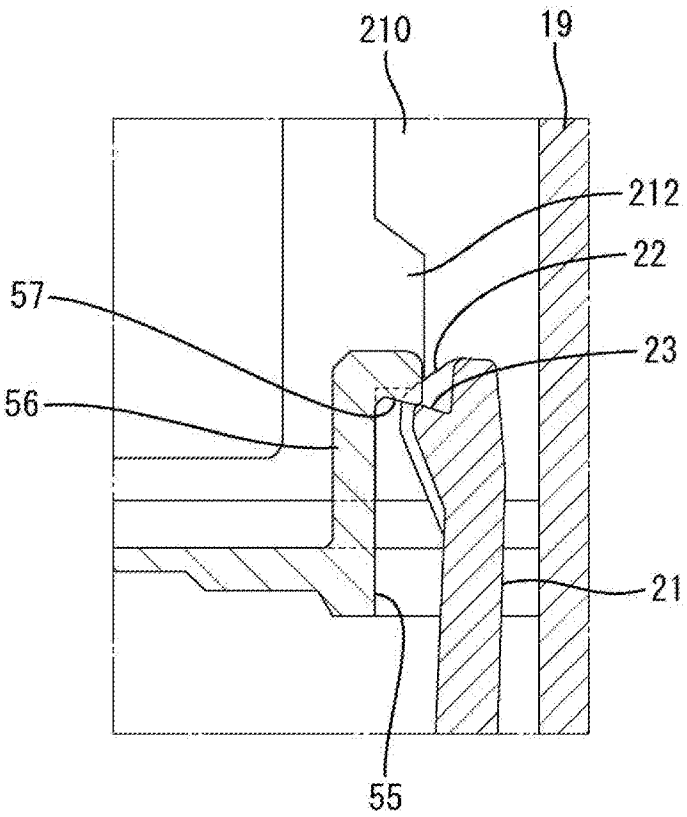
FIG. 12A is an enlarged section showing a state where the plate male locking portion is pressed by the releasing portion to be deflected in a direction to be disengaged from the male housing locking portion in the process of connecting the housings.

As the connection of the housings 10, 210 proceeds, the releasing portion 212 slides in contact with the release guiding surface 22 of the male housing lock 21 and the male housing lock 21 is deflected and deformed in a direction to release the locking with the plate male lock 56, as shown in FIG. 12A. The male engaging projection 57 of the plate male lock 56 decreases a locking margin with the locking surface 23 of the male housing lock 21. In this way, the locking of the plate male lock 56 and the male housing lock 21 is released.

As shown in FIG. 12B, the female housing locks 267 resiliently return and the female engaging projections 268 of the female housing locks 267 are locked to the plate engaging projections 66 of the plate female locks 63. Further, the female engaging projections 268 of the female housing locks 66 are separated from the plate engaging projections 66 of the plate female locks 62. On the other hand, a clearance C1 (gap) is formed in the front-rear direction between the female housing 210 and the protection wall 51. Thus, the moving plate 50 can be kept at the protection position. During this time, the tip of the male tab 42 of each male terminal fitting 40 is positioned and inserted in each positioning hole 53 of the protection wall 51 and kept protected by the protection wall 51.

As the connection of the housings 10, 210 proceeds, the female housing 210 contacts the protection wall 51, and the moving plate 50 is pressed by the female housing 210 to move toward the connection position. At this time, the tips of the female housing locks 266 can contact the protection wall 51, but the tips of the female housing locks 267 are spaced from the protection wall 51. Further, the release guiding surface 22 of the male housing lock 21 passes through the releasing portion 212 and the male housing lock 21 resiliently returns.

When each cam follower 27 reaches the back side of each cam groove 242 and the housings 10, 210 are connected properly, the male engaging projection 57 of the plate male lock 56 is separated from the releasing portion 212, as shown in FIG. 13A. The moving plate 50 reaches the connection position and is sandwiched between the female housing 210 and the back surface of the receptacle 12 (front surface of the housing body 11). At this time, as shown in FIG. 13B, the female engaging projections 268 of the female housing locks 267 also are separated from the plate engaging projections 66 of the plate female locks 63.

When the moving plate 50 reaches the connection position, the male tab 42 of each male terminal fitting 40 projects forward from the protection wall 51, is inserted into the female housing 210 and is connected electrically to the female terminal fitting 250. Further, when the moving plate 50 reaches the connection position, the front part of the outer peripheral surface of the female housing 210 faces the inner peripheral surface of the seal 70 and is held resiliently in close contact with each inner peripheral lip 71. In this way, sealing is provided between the housings 10, 210 in a liquid-tight manner.

Figure 14A:
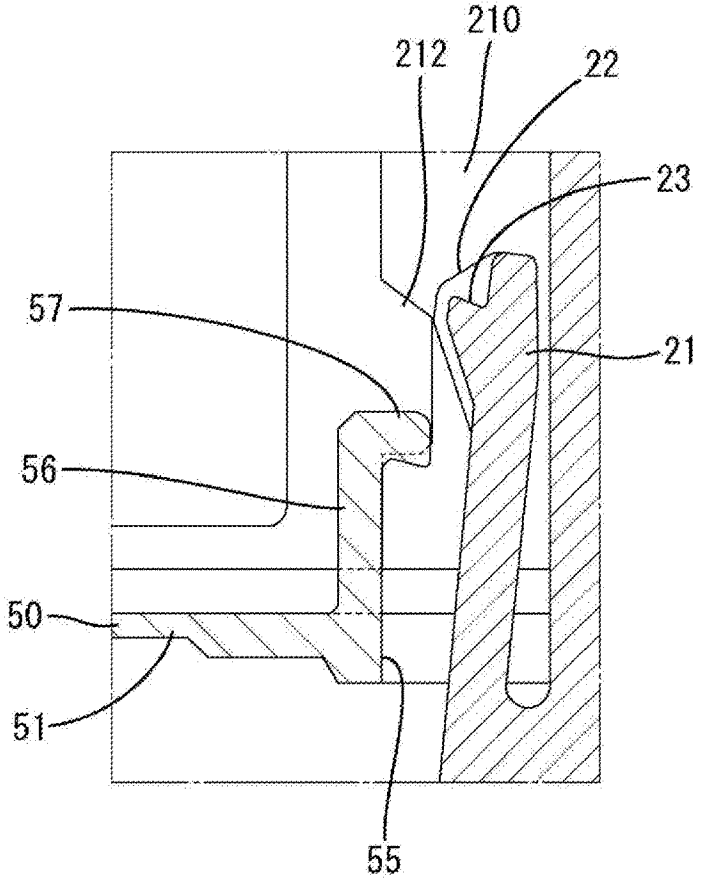
FIG. 14A is an enlarged section showing a state where the plate male locking portion is deflected and deformed in a direction to ride on the releasing portion in the process of separating the housings.

On the other hand, in separating the housings 10, 210, the lever 40 is rotated in a direction opposite to the one at the time of connection. Then, the female housing 210 moves in the direction to escape from the receptacle 12. In an initial stage of a separation process of the housings 10, 210, the female housing 210 is separated from the protection wall 51 and the female engaging projections 268 of the female housing locks 267 contact the plate engaging projections 66 of the plate female locks 63 to be locked thereto, as shown in FIG. 14B. At this time, the female engaging projections 268 of the female housing locks 267 are located away from the plate engaging projections 66 of the plate female locks 62. Further, as shown in FIG. 14A, the tip of the male housing lock 21 rides on the releasing portion 212 and the male housing lock 21 is deflected and deformed.

Separation of the housings 10, 210 proceeds as the lever 240 is rotated. The female engaging projections 268 of the female housing-side locks 267 remain locked to the female engaging projections 268 of the plate female locks 63 as separation of the housings 10, 210 proceeds. Thus, the moving plate 50 is moved together with the female housing 210 and pulled up to the opening side of the receptacle 12.

The male housing lock 21 resiliently returns when the tip of the male housing lock 21 rides over the releasing portion 212. Then, the locking surface 23 of the male housing lock 21 reaches a position to be locked to the male engaging projection 57 of the plate male lock 56. The closing surfaces of the stopper receiving portions 61 of the retaining portions 59 contact the respective stoppers 25 to hinder a movement (pull-up) of the moving plate 50. At this time, the female engaging projections 268 of the female housing locks 267 interfere with the plate engaging projections 66 of the plate female locks 63 and the female housing locks 267 are deflected. Further, the female engaging projections 268 of the female housing locks 266 are locked to the plate engaging projections 66 of the plate female locks 62. This is the same state as in the connection starting stage described above. In this way, the moving plate 50 is stopped at the protection position with respect to the male housing 10.

Figure 15A:
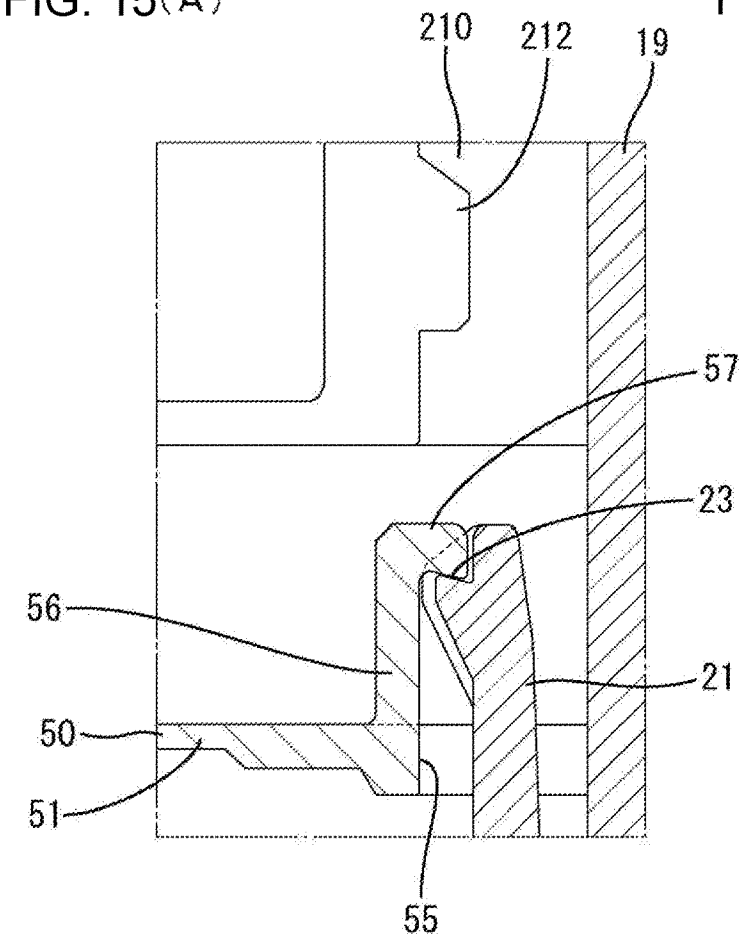
FIG. 15A is an enlarged section showing a state where the plate male locking portion is locked to the male housing locking portion when the separation of the housings is completed.

When the separation of the housings 10, 210 proceeds further, the female engaging projections 268 of the female housing locks 267 resiliently ride over the plate engaging projections 66 of the plate female locks 63. Further, the female engaging projections 268 of the female housing locks 266 also resiliently ride over the plate engaging projections 66 of the plate female locks 62. In that state, as shown in FIGS. 15A and 15B, the housings 10, 210 are pulled apart from each other.

As described above, the state where the male housing lock 21 is locked to the plate male lock 56 and the state where the female housing locks 266 are locked to the plate female locks 62 occur simultaneously in the connection starting stage of the housings 10, 210. Thus, in the connection starting stage of the housings 10, 210, a mutual positional relationship of the moving plate 50, the female housing 210 and the male housing 10 is determined and a mutual interlocking relationship can be built. As a result, the moving plate 50 can move smoothly from the protection position to the connection position according to the connecting operation of the female housing-side 210.

Further, while the lever 240 is rotated from the connection starting stage, the connection of the housings 10, 210 proceeds within the range of the clearance C1 formed between the female housing 210 and the protection wall 51, whereas the moving plate 50 is kept at the protection position. That is, there is a time lag until a movement of the moving plate 50 to the connection position is started after the locking of the male housing lock 21 and the plate male lock 56 is released. Thus, the tips of the male tabs 42 are protected by the moving plate 50 while the locking of the male housing lock 21 and the plate male lock 56 is released, thereby improving reliability in protecting the male tabs 42.

Furthermore, at the time of separating the housings 10, 210, the female housing locks 267 are locked to the plate female locks 63 with the locking of the male housing lock 21 and the plate male lock 56 released. Thus, the moving plate 50 can be returned to the protection position according to the separating operation of the female housing 210.

The embodiment disclosed above is illustrative rather than restrictive in all aspects.

Locking of the female housing locks to the plate female locks occurs earlier than locking the female housing locks to the plate female locks in the above embodiment. However, the locking of the female housing locks to the plate female locks may be the same as the locking of the female housing locks to the plate female locks. Note that the female housing locks and the plate female locks can also be omitted.

Although the female connector is provided with the lever in the above embodiment, the male connector may be provided with the lever as another embodiment.

Although the lever is mounted on the grommet cover in the case of the above embodiment, the lever may be mounted on the female housing or the male housing as another embodiment. Note that the lever can also be omitted.

LIST OF REFERENCE SIGNS

10 . . . male housing
11 . . . housing body
12 . . . receptacle
13 . . . male cavity
14 . . . first sub-housing accommodating portion
15 . . . second sub-housing accommodating portion
16 . . . housing lock
17 . . . first male sub-housing
18 . . . second male sub-housing
19 . . . projection
21 . . . male housing lock
22 . . . release guiding surface
23 . . . locking surface
24 . . . insertion recess
25 . . . stopper
27 . . . cam follower
28 . . . lock mounting portion
29 . . . step
30 . . . lock
32 . . . hook
33 . . . mounting groove
40 . . . male terminal fitting
41 . . . body
42 . . . male tab
43 . . . barrel
50 . . . moving plate
51 . . . protection wall
52 . . . peripheral wall
53 . . . positioning hole
54 . . . housing insertion hole
55 . . . through hole
56 . . . plate male lock
57 . . . male engaging projection
58 . . . projecting piece
59 . . . retaining portion
61 . . . stopper receiving portion
62 . . . plate female lock
63 . . . plate female lock
64 . . . first piece
65 . . . second piece
66 . . . plate engaging projection
67 . . . through hole
70 . . . seal
71 . . . inner peripheral lip
72 . . . outer peripheral lip
80 . . . wire
90 . . . panel seal
91 . . . rear lip
92 . . . front lip
100 . . . panel
110 . . . mounting hole
210 . . . female housing
211 . . . receiving portion
212 . . . releasing portion
213 . . . female cavity
214 . . . tab insertion hole
215 . . . through hole
216 . . . first female sub-housing
217 . . . second female sub-housing
219 . . . stopp
220 . . . grommet
224 . . . cover
225 . . . pipe
226 . . . stopping hole
230 . . . grommet cover
231 . . . support shaft
240 . . . lever
241 . . . cam plate
242 . . . cam groove
243 . . . bearing hole
250 . . . female terminal fitting
261 . . . locking hole
262 . . . lock hole
263 . . . separation wall
264 . . . first back wall
264F . . . front surface of first back wall

265 . . . second back wall portion
265F . . . front surface of second back wall
266 . . . female housing lock
267 . . . female housing lock
268 . . . female engaging projection
C1 . . . clearance

What is claimed is:

1. A connector, comprising:

a male housing (10) with opposite front and rear ends spaced apart along a connecting direction and including a forwardly open receptacle (12), a male tab (42) projecting forward into the receptacle (12);

a female housing (210) to be fit into the receptacle (12) of the male housing (10 along the connecting direction; and a moving plate (50) to be arranged in the receptacle (12), wherein:

the moving plate (50) moves into the receptacle and toward the rear end of the male housing (10) from a protection position for protecting a tip part of the male tab (42) to a connection position according to a connecting operation of the female housing (210), the male housing (10) includes a resiliently deflectable male housing lock (21) cantilevered forward in the receptacle (12), the female housing (210) includes a resiliently deflectable female housing lock (266, 267) cantilevered from a position rearward of an end of the female housing (210) that is fit in the receptacle (12) and extending toward the rear end of the male housing (10) when the female housing (210) is fit in the receptacle (12) of the male housing (10), and the moving plate (50) includes:

a rigid plate male lock (56) for locking the male housing lock (21) at the protection position to restrict a movement to the connection position; and at least one rigid plate female lock (62, 63) for locking the female housing lock (266, 267) to restrict separation of the female housing (210) when locking the male housing lock (21) and the rigid plate male lock (56) is maintained.

2. The connector of claim 1, wherein a clearance for allowing the female housing (210) to move toward the moving plate (50) is set until locking of the male housing lock (21) and the plate male lock (56) is released and the moving plate (50) starts to move to the connection position.

3. The connector of claim 2, wherein:

the resiliently deflectable female housing lock (266, 267) is configured to deflect relative to the rigid plate female lock (62, 63) to enable a movement of the moving plate (50) to the protection position when the locking of the resiliently deflectable male housing lock (21) and the rigid plate male lock (56) is released at the time of separating the housings (10, 210).

4. The connector of claim 1, wherein:

the resiliently deflectable female housing lock (266, 267) is configured to deflect relative to the rigid plate female lock (62, 63) to enable a movement of the moving plate (50) to the protection position when the locking of the resiliently deflectable male housing lock (21) and the rigid plate male lock (56) is released at the time of separating the housings (10, 210).

5. The connector of claim 1, wherein the moving plate (50) includes a protection wall (51) extending transverse to the connecting direction, positioning holes (53) extending through the protection wall (51) in the connecting direction and receiving the tip part of the male tab (42) when the moving plate is at the protection position.

6. The connector of claim 5, wherein rigid plate male lock (56) includes a plate projecting forward from the protection wall (51) along the connecting direction and a male engaging projection (57) extending from an end of the plate spaced from the protection wall (51) in a direction transverse to the connecting direction.

7. The connector of claim 5, wherein the at least one rigid plate female lock (62) includes first and second plate pieces (64, 65) projecting forward from the protection wall (51) along the connecting direction, the first and second plate pieces (64, 65) being connected to one another and being aligned substantially perpendicular to one another, the rigid plate female lock (62) further including a plate engaging projection (66) projecting from an end of the first plate piece (64) spaced from the protection wall (51).

8. The connector of claim 7, wherein the at least one rigid plate female lock (62) includes a plurality of rigid plate female lots (62).

9. The connector of claim 1, wherein a leading end of the resiliently deflectable female housing lock (266, 267) is at a position at or rearward of an end of the female housing (210) that is inserted into the receptacle (12).

* * * * *